United States Patent [19]

Brown

[11] Patent Number: 4,507,874

[45] Date of Patent: Apr. 2, 1985

[54] BOW SIGHT

[76] Inventor: Dewey E. Brown, Rte. 4, Box 126, Bastrop, La. 71220

[21] Appl. No.: 512,355

[22] Filed: Jul. 11, 1983

[51] Int. Cl.[3] ..... F41G 1/46

[52] U.S. Cl. ..... 33/265; 124/87

[58] Field of Search ..... 33/265; 124/87; 356/21, 356/22

[56] References Cited

U.S. PATENT DOCUMENTS 4,167,333 9/1979 Young et al. ..... 33/265

4,178,693 12/1979 Smith ..... 33/265

*Primary Examiner*—William D. Martin, Jr.

*Attorney, Agent, or Firm*—John M. Harrison

[57] ABSTRACT

A bow sight for use with compound bows, recurve bows and long bows which includes a housing enclosing a bottom mirror, a top mirror mounted in spaced relationship in the housing with respect to the top mirror and a compensating mirror positioned in the housing in close proximity to the bottom mirror and smaller than the bottom mirror. The top and bottom mirrors are mounted in substantially parallel relationship at approximately a 45° angle in the housing and the top mirror and compensating mirror are pivotally mounted in order to provide the necessary adjustment to determine a proper trajectory for accurately delivering an arrow to the target when the target is viewed through the bottom mirror and the target image in the bottom mirror is compared to the target image from the compensating mirror.

20 Claims, 5 Drawing Figures

BOW SIGHT

BACKGROUND OF THE INVENTION

1. Field of the Invention

It is well known that archery is an extremely difficult sport, in that the delivery of an arrow accurately to a target depends upon several variables. Such variables include the length and position of the draw, the steadiness with which the bow is held in the hand and the release of the arrow from the same anchor point with each shot. In addition, the elevation of the arrow must be adjusted to compensate for the distance over which it is to travel and an adjustment must frequently be made for windage. The delivery of an arrow accurately in order to kill game efficiently is particularly difficult due to the variables described above. This difficulty is increased because of the human error in accurately judging distance, a shortcoming which sometimes results in the arrow either falling short of, or flying over the target. Such errors in judging distances can be minimized by the use of sight pins and sighting devices of various design, which aid one in determining the distance between himself and the target.

2. Description of the Prior Art

Various devices are known in the art for increasing the accuracy of an arrow delivered to a target. Typical of such devices is the "Archer's Bow" disclosed in U.S. Pat. No. 2,001,470 to Y. J. Nyvall, which device discloses a folding bow having a pair of top and bottom mirrors serving to reflect the target, the image of which is reflected by the top mirror onto the bottom mirror and thence to the eye of an archer. The lower mirror is reticulated in such relation to the longitudinal center of an arrow seated on arrow support ledges in the bow, that when the target appears in the lower mirror at the intersection of cross hairs in the reticule, the arrow can be accurately directed toward the target. The patent makes it clear however, that an aiming allowance must be made for trajectory and for air currents. U.S. Pat. No. 3,163,697 to D. S. White, discloses an "Archery Bow Sight Utilizing Optical Range Finder and Coupled Sighting Element". The patent is drawn to a dual, spaced mirror device arranged such that the viewer will simultaneously see both a real and a reflected target image. As the viewer looks at a target, a slide is manipulated until real and reflected images are both seen at the same height. When this position is reached, the bow is aimed at the target and is properly positioned so that an arrow shot from the bow will assume the proper trajectory for the distance of the target.

U.S. Pat. No. 3,524,440 to Walter D. Hill, discloses an "Archery Bow Including Mirror Sighting Device" which includes an upper and lower mirror aligned in substantially vertical relationship with respect to each other forwardly of the bow, with cross hairs or other target-aligning means mounted on one of the mirrors. The lower mirror is focused on the target while the upper mirror is focused on the lower mirror and reflects the target image to the archers eye. The mirror mounting the cross hairs may be adjusted vertically to compensate for distance and horizontally, to compensate for windage. U.S. Pat. No. 3,861,051 to Gerald I. Killian, discloses an "Arrow Draw Check for Archery Bows" which includes a mirror mounted for movement with an archery bow sight and arranged to reflect to the eye of the archer, the image of a tip of a drawn arrow in registry with an index mark on the mirror. A "Range Finding Device for Archery Bows" is disclosed in U.S. Pat. No. 2,788,701 to G. G. Browning, which device incorporates multiple mirrors mounted below a single upper mirror for reflecting the image of the target and transmitting this image to the eye at various levels to facilitate trajectory adjustment of the bow for accurate delivery of an arrow to a target.

It is an object of this invention to provide a bow sight for long bows, recurve bows and compound bows, which sight assists the archer in adjusting the bow trajectory for distance.

It is a further object of this invention to provide a bow sight which is applicable to bows of varying contour, design and construction and which is easily adjustable to compensate for the drop of an arrow over a wide range of distances.

Another object of this invention is to provide a new and improved sight for long bows, recurve bows and compound bows, which is characterized by a housing carrying three enclosed mirrors, one of which mirrors is adjustably mounted at the top of a housing, another fixedly mounted at the bottom of the housing and the third compensating mirror adjustably located between the top and bottom mirrors for determining when a range compensation should be made relative to a previously determined target distance.

A still further object of the invention is to provide a new and improved bow sight for recurve bows, long bows and compound bows which includes a periscope device having a compensating mirror mounted between top and bottom mirrors, which compensating mirror serves to determine when the target is at a range which is either greater than or less than a predetermined and calibrated range when the archer views the target through the bottom mirror.

SUMMARY OF THE INVENTION

These and other objects of the invention are provided in a bow sight which is suitable for mounting on a long bow, a recurve bow or a compound bow, which bow sight includes a periscope device enclosing a top and bottom mirror mounted in generally 45° angular relationship with respect to each other in order to transmit a target image from the top to the bottom mirror and a compensating mirror mounted in close proximity to the bottom mirror and independently receiving the target image along with the bottom mirror, which compensating mirror serves to determine trajectory adjustments which must be made in a predetermined target distance in order to accurately deliver the arrow to the target when the target is viewed through the bottom mirror.

BRIEF DESCRIPTION OF THE DRAWING

The invention will be better understood by reference to the accompanying drawing wherein.

DESCRIPTION OF THE PREFERRED EMBODIMENTS

Figure 3:
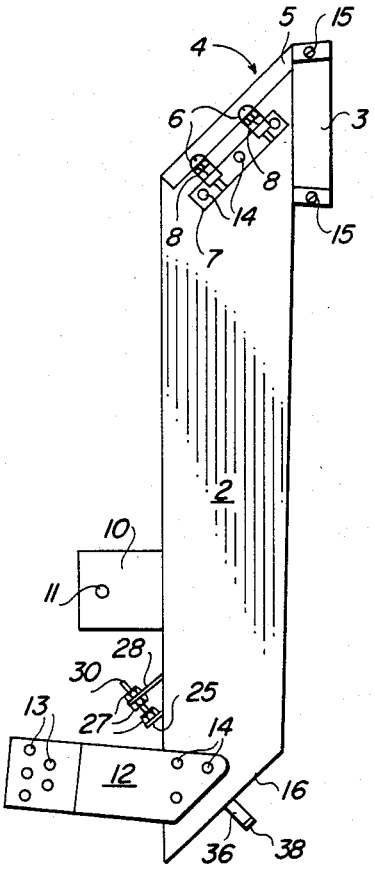
FIG. 3 is right side view of the bow sight.

Referring to FIGS. 1–4 of the drawing in a preferred embodiment, the bow sight of this invention is generally illustrated by reference numeral 1 and includes an elongated housing 2, having a hood 3 projecting from one end thereof. The housing 2 is provided with a removable top mirror plate 4, which is bolted to the plate flanges 5, extending from the housing 2 by means of plate bolts 6 and adjusting nuts 8, which also cooperate with a plate bolt flange 7, secured to each side of the housing 2. A mount bracket 10 extends rearwardly from the housing 2 and is removably fastened to the bow riser 18 of a bow 17, by means of a mounting bolt 9. As illustrated in FIG. 3, the mount bracket 10 is provided with a mount bracket aperture 11, through which the mounting bolt 9 extends in order to cooperate with the bow riser 18 of bow 17 and removably secure the bow sight 1 to the bow 17. A sight pin bracket 12 extends rearwardly from the housing 2 beneath the mount bracket 10 and is provided with sight pin apertures 13, which are located to receive optional sight pins [not illustrated], as desired. It will be appreciated that several sight pins can be provided in the sight pin bracket apertures 13 to define various trajectories at different distances from a target, as deemed necessary by the archer. The hood 3 extends forwardly of the housing 2 and portions of the plate flanges 5, carried by the top mirror plate 4, are secured to the hood 3 by means of bolts 15 and cooperating nuts (not illustrated). In a preferred embodiment of the invention the housing 2 is constructed of aluminum and the mount bracket 10 and sight pin bracket 12 are secured to the housing 2 by means of rivets 14.

Figure 1:
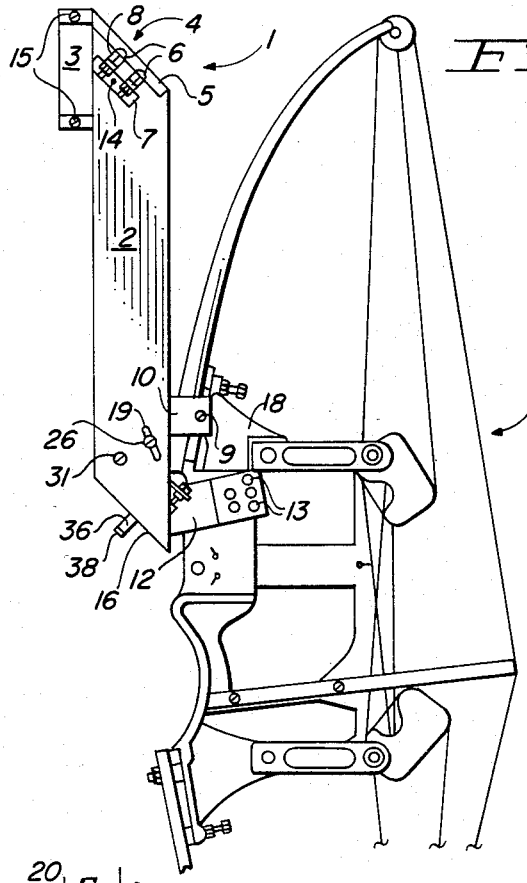
FIG. 1 is a side view of preferred embodiment of the bow sight mounted on a compound bow.
Figure 2:
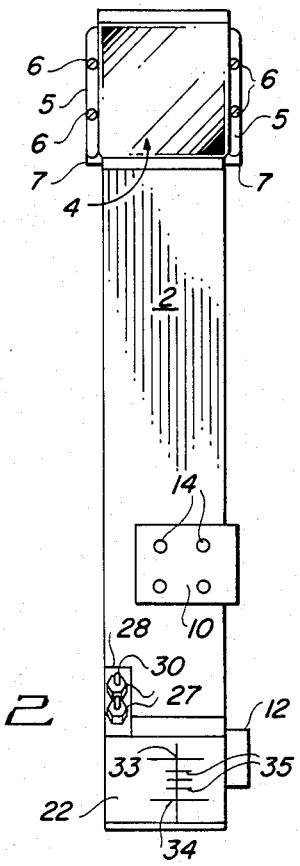
FIG. 2 is a rear or viewing configuration of the bow sight illustrated in FIG. 1.
Figure 4:
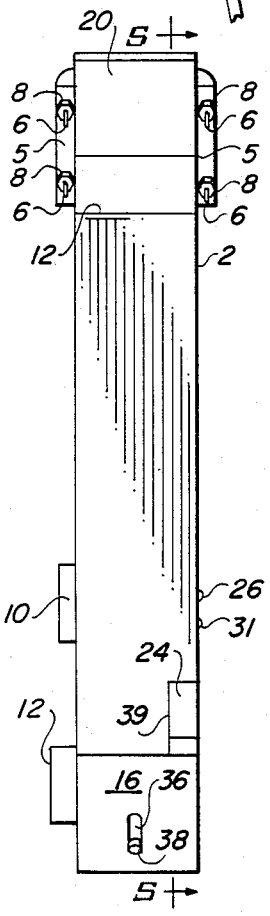
FIG. 4 is front view of the bow sight.
Figure 5:
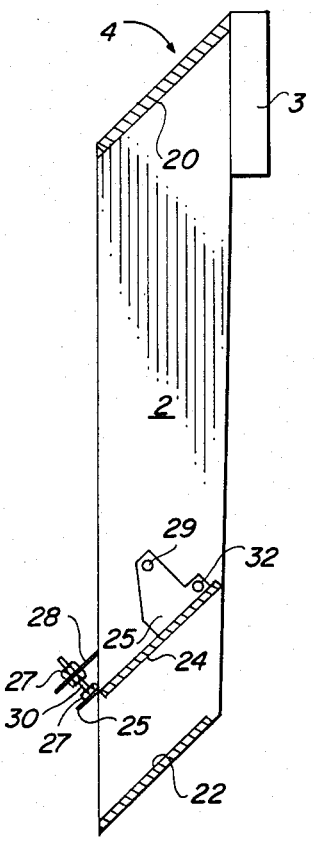
FIG. 5 is sectional view of the bow sight, taken along line 5—5 in FIG. 4.

Referring now to FIGS. 1–5 and to FIG. 5 in particular, a top mirror 20 is secured to the inside of the top mirror plate 4 and is disposed in angular relationship inside the housing 2 and opposite the hood 3, in order to face outwardly of the top housing opening 21, surrounded by the hood 3. Similarly, a bottom mirror 22 is disposed in angular relationship in the interior of the bottom 16 of the housing 2, opposite the bottom housing opening 23 which is open to a viewer. The top mirror 20 and bottom mirror 22 are disposed inside the housing 2 in generally parallel relationship, such that the housing 2 acts as a periscope, wherein the image of objects focused in the top mirror 20 are transferred to the bottom mirror 22 and to an observer facing the bottom housing opening 23 and viewing the bottom mirror 22. In a most preferred embodiment of the invention a relatively thin compensating mirror 24, is provided in generally parallel orientation with respect to the top mirror 20 and the bottom mirror 22 and one end of the compensating mirror 24 is secured inside the housing 2 by means of a pivot bolt 31 and a windage bolt 26, spaced from the pivot bolt 31. The pivot bolt 31 and windage bolt 26 are secured in registration with a pivot bolt aperture 32 and a windage bolt aperture 29, respectively, provided in spaced relationship in a compensating bracket 25, extending upwardly from and attached to the compensating mirror 24. The opposite end of the compensating bracket 25 extends downwardly and is adjustably secured to an elevation bracket 28, by means of an elevation bolt 30 and cooperating elevation nuts 27. The elevation bolt 30 extends through the elevation bracket 28, which is attached to the housing 2 and the elevation bolt 30 is fixedly secured to one end of the compensating bracket 25, which extends beyond the lower end of the compensating mirror 24. A compensating mirror opening 39 is provided in the front segment of the housing 2 below the top housing opening 21 and opposite the compensating mirror 24. In yet another most preferred embodiment and referring again to FIG. 1, a slot 19 is provided in the side of the housing 2 and receives the windage bolt 26 in order to better facilitate adjustment of both the elevation and the windage in the bow sight 1, as hereinafter described. As further illustrated in FIG. 2, in yet another preferred embodiment of the invention the bottom mirror 22 is provided with vertical and horizontal reticles which intersect to define a top cross hair 33, a bottom cross hair 34 and intermediate reticles 35, located between the top cross hair 34 and the bottom cross hair 35. Furthermore, as illustrated in FIGS. 1, 3 and 4, in a still further preferred embodiment a light housing 36, is mounted in the bottom 16 of the housing 2 and includes a light switch 38, for selective activitation of a light [not illustrated] located inside the light housing 36 and powered by a battery. This light serves to illuminate the bottom mirror 22 and facilitates use of the bow sight 1 in early morning and late evening, under circumstances of poor light.

In operation and referring again to the drawing, the bow sight 1 of this invention is calibrated and used as follows. The bow sight 1 is initially mounted securely to the bow riser 18 of the bow 17 by means of mounting bolt 9 and a cooperating mounting nut [not illustrated]. A target is then set up at a selected distance from the archer, for example, 50 yards and arrows are delivered to the target to determine what adjustment should be made to the bow sight 1 in order to hit the target. The top mirror 20, secured to the top mirror plate 4, is adjusted by manipulating the plate bolts 6 and the cooperating adjusting nuts 8 to tilt the top mirror 20 with respect to the bottom mirror 22, until a trajectory is found where arrows can be delivered with reasonable accuracy to the target when the target is sighted in the top mirror 20 and viewed by the archer in the bottom mirror 22, at a selected one of the top cross hairs 33, bottom cross hairs 34 or one of the intermediate reticles 35. In this manner, the archer can deliver an arrow along an accurate trajectory to a target 50 yards distant by sighting the target on a selected cross hair or intermediate reticle inscribed on the bottom mirror 22, or by using a sight pin mounted in one of the sight pin bracket apertures 13 in the sight pin bracket 12. When this setting of the bow sight 1 is achieved, the top mirror 20 is again focussed on the target and the compensating mirror 24 is then adjusted by loosening the windage bolt 26 and manipulating the elevation bolt 30 and the cooperating elevation nuts 27 to the point where the narrow target image as it appears through the compensating mirror opening 39 in the narrow compensating mirror 24 and as reflected on the bottom mirror 22, is at the same elevation as it appears in a wider field in the bottom mirror 22 as reflected from the top mirror 20. Compensation for lateral displacement of the arrows from the target can also be achieved by means of the compensating mirror 24 by manipulation and adjustment of the windage bolt 26 to move the compensating mirror 24 laterally inside the housing 2. The target can then be moved to a distance of 60 yards, for example, and the above procedure repeated, using a different one of the top cross hair 33, bottom cross hair 34 or intermediate reticles 35 to sight the bow in for that yardage. Additional calibrated arrow trajectory settings can be achieved at other selected and known distances with selected ones of the top cross hair 33, bottom cross hair 34 and intermediate reticles 35 chosen to calibrate the bow sight 1, according to the desires of the archer.

When it is desired to use the bow 17 and bow sight 1 for hunting, the bow sight 1 is pointed toward the intended game and the game is viewed indirectly by means of the top mirror 20 through the bottom mirror 22 and by the compensating mirror 24 at a lower elevation and the narrow game image in the bottom mirror 22 reflected from the compensating mirror 24 is compared to the wider image in the bottom mirror 22 reflected from the top mirror 20. The target distance between the archer and the game is then estimated and the appropriate one of the top cross hair 33, bottom cross hair 34 or intermediate reticles 35 which corresponds to the distance used to calibrate the bow sight 1 which is closest to the estimated target distance, is aligned with the target. The target image in the bottom mirror 22 as reflected from the compensating mirror 24 is then again checked to determine whether or not this image is higher or lower than the target image observed in the bottom mirror 22 and reflected from the top mirror 20. If the target image reflected from the compensating mirror 24 is higher than or equal to the target image reflected from the top mirror 20, then the selected one of the top cross hair 33, bottom cross hair 34 or the intermediate reticles 35 is held directly on the target and the arrow is released. However, if the target image from the compensating mirror 24 is noted to be lower than the target image received from the top mirror 20, then the archer must elevate the arrow in order to adjust the trajectory and strike the target. Accordingly, the archer makes this adjustment in trajectory by reading the appropriate one of the intermediate reticles 35 or the bottom cross hair 34 which corresponds to the amount of elevation adjustment necessary, according to his estimate, for the arrow to strike the target.

It will be appreciated by those skilled in the art that the respective spaces between the top cross hair 33, the intermediate reticles 35 and the bottom cross hair 34 can be selected and chosen such that each space represents a specific distance of arrow travel, for example, 5 yards. Accordingly, if the bow sight 1 is sighted in or calibrated on a target at 50 yards distance using the bottom cross hair 34 and the target image from the compensating mirror 24 is lower than the target image from the top mirror 20, then the archer knows that he must compensate for the extended distance of the target and that such compensation will be graduated in increments of 5 yards for each of the intermediate reticles 35 located above the bottom cross hair 34 originally sighted.

Referring again to FIG. 3 of the drawing and as described above, it will be appreciated by those skilled in the art that sight pins [not illustrated] can be inserted in the sight pin apertures 13 in lieu of using the top cross hair 33, bottom cross hair 34 and the intermediate reticles 35 which are inscribed on the bottom mirror 22, in order to locate an accurate trajectory for delivery of an arrow to the target by reference to the target image from the compensating mirror 24 and the top mirror 20 according to the procedure outlined above.

As further illustrated in the drawing it will be appreciated that the length of the housing 2 and the distance between the top mirror 20 and the bottom mirror 22 is not critical. However, in a most preferred embodiment the distance between the top mirror 20 and the bottom mirror 22 is from about 10 to about 15 inches and most preferably, about 12 inches. Furthermore, it has been found that the compensating mirror 24 should be from about 1 inch to about three inches, and most preferably, about two inches, from the bottom mirror 22, in order to reflect a sufficiently contrasting target image in comparison with the target image reflected to in the bottom mirror 22 by the top mirror 20, to facilitate accurate adjustment of the arrow trajectory. However, it is understood that the spacing between the top mirror 20 and the bottom mirror 22, and between the bottom mirror 22 and the compensating mirror 24 is optional, since the requisite trajectory corrections are made by comparison between sight pin or cross hair and reticle settings used to calibrate the bow sight 1 and a comparison of target images in the bottom mirror 22 from the compensating mirror 24 and the top mirror 20.

It will also be appreciated from a consideration of FIG. 1 of the drawing that the field of view of the top mirror 20 more closely approximates the flight of an arrow released from the bow 17, than does the ordinary line of sight of the archer to the target. Accordingly, viewing the target by focussing the top mirror 20 thereon allows the viewer to spot potential impediments to the arrow, such as limbs, brush and the like, with greater accuracy than is possible with line-of-sight shooting. This added advantage is possible because the top mirror 20 is at a higher elevation than the line of sight of the archer and the arrow must travel in an arc. Consequently, the top mirror 20 is closer to the highest point in the arc than is the sight line from the archer to the target.

It will be further appreciated that the top mirror 20, bottom mirror 22 and compensating mirror 24 are enclosed in the housing 2 to minimize reflection of sunlight in the mirrors. Referring again to FIGS. 1 and 3, the hood 3 is designed to further shade and protect the top mirror 20 from unwanted reflections which can prevent accurate viewing of game or other targets in the bottom mirror 22.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A bow sight comprising a housing; a first opening in one end of said housing and a top mirror adjustably positioned in said one end of said housing and facing said first opening; a second opening in the opposite end of said housing and facing opposite said first opening and a bottom mirror in said opposite end of said housing facing said second opening and disposed in generally parallel relationship with respect to said top mirror; and a third opening in said housing between said first opening and said second opening and facing opposite said second opening and a compensating mirror adjustably positioned in said housing and facing said third opening, whereby a target image received by said top mirror and reflected to said bottom mirror is reflected by said bottom mirror to a viewer and the target image is simultaneously reflected by said compensating mirror to said bottom mirror and to the viewer for comparison and correction of an arrow trajectory.

2. The bow sight of claim 1 wherein said compensating mirror is closer to said bottom mirror than to said top mirror.

3. The bow sight of claim 1 further comprising a mount bracket carried by said housing for mounting said bow sight to a bow.

4. The bow sight of claim 1 further comprising a sight pin bracket carried by said housing and extending from said housing and into a line of sight to said bottom mirror, whereby at least one sight pin can be fitted to said bow sight and aligned with a target image in said bottom mirror to determine an arrow trajectory.

5. The bow sight of claim 1 wherein said compensating mirror is closer to said bottom mirror than to said top mirror and further comprising:

(a) a mount bracket carried by said housing for mounting said bow sight to a bow; and (b) a sight pin bracket carried by said housing and extending from said housing and into a line of sight to said bottom mirror, whereby at least one sight pin can be fitted to said bow sight and aligned with a target image in said bottom mirror to determine an arrow trajectory.

6. The bow sight of claim 1 further comprising adjusting means in cooperation with said compensating mirror and said housing for causing the target image in said compensating mirror to align with the target image in said bottom mirror when said top mirror and said compensating mirror are focussed on a target.

7. The bow sight of claim 1 wherein said compensating mirror is closer to said bottom mirror than to said top mirror and further comprising:

(a) a mount bracket carried by said housing for mounting said bow sight to a bow;

(b) a sight pin bracket carried by said housing and extending from said housing and into a line of sight to said bottom mirror, whereby at least one sight pin can be fitted to said bow sight and aligned with a target image in said bottom mirror to determine an arrow trajectory; and (c) adjusting means in cooperation with said compensating mirror and said housing for causing the target image in said compensating mirror to align with the target image in said bottom mirror when said top mirror and said compensating mirror are focussed on a target.

8. The bow sight of claim 1 further comprising light means mounted in said housing beneath said bottom mirror for illuminating said bottom mirror.

9. The bow sight of claim 1 wherein said compensating mirror is closer to said bottom mirror than to said top mirror and further comprising:

(a) a mount bracket carried by said housing for mounting said bow sight to a bow;

(b) a sight pin bracket carried by said housing and extending from said housing and into a line of sight to said bottom mirror, whereby at least one sight pin can be fitted to said bow sight and aligned with a target image in said bottom mirror to determine an arrow trajectory; and (c) adjusting means in cooperation with said compensating mirror and said housing for causing the target image in said compensating mirror to align with the target image in said bottom mirror when said top mirror and said compensating mirror are focussed on a target; and (d) light means mounted in said housing beneath said bottom mirror for illuminating said bottom mirror.

10. The bow sight of claim 9 further comprising hood means cooperating with said housing and extending around the periphery of said first opening.

11. A bow sight comprising:

(a) a generally elongated housing;

(b) a first opening in one end of said housing transverse to the longitudinal axis of said housing and a first mirror adjustably mounted in angular relationship in said housing and facing said first opening;

(c) a second opening in the opposite end of said housing transverse to the longitudinal axis of said housing and disposed 180 degrees from said first opening and a second mirror mounted in said opposite end of said housing in substantially parallel relationship with respect to said first mirror and facing said second opening; and (d) a third opening in said housing between said first opening and said second opening and disposed 180 degrees from said second opening and a compensating mirror facing said third opening and having a width which is less than the width of said first mirror and said second mirror, said compensating mirror adjustably mounted in said housing in substantially parallel relationship with respect to said first mirror and said second mirror, whereby a target image received by said first mirror is reflected to said second mirror and from said second mirror to a viewer and the target image simultaneously received by said compensating mirror is reflected to said second mirror and to the viewer for comparison and correction of an arrow trajectory.

12. The bow sight of claim 11 wherein said compensating mirror is closer to said second mirror than to said first mirror.

13. The bow sight of claim 11 further comprising a mount bracket carried by said housing for mounting said bow sight to a bow.

14. The bow sight of claim 11 wherein said compensating mirror is closer to said second mirror than to said first mirror and further comprising a mount bracket carried by said housing for mounting said bow sight to a bow.

15. The bow sight of claim 11 further comprising a sight pin bracket carried by said housing and extending from said housing and into a line of sight to said second mirror, whereby at least one sight pin can be fitted to said bow sight and aligned with a target image in said second mirror to determine an arrow trajectory.

16. The bow sight of claim 11 wherein said compensating mirror is closer to said second mirror than to said first mirror and further comprising:

(a) a mount bracket carried by said housing for mounting said bow sight to a bow; and (b) a sight pin bracket carried by said housing and extending from said housing and into a line of sight to said second mirror, whereby at least one sight pin can be fitted to said bow sight and aligned with a target image in said second mirror to determine an arrow trajectory.

17. The bow sight of claim 1 further comprising adjusting means in cooperation with said compensating mirror and said housing for causing the target image in said compensating mirror and reflected to said second mirror to align with the target image reflected from said first mirror to said second mirror when said first mirror and said compensating mirror are both focussed on a target.

18. The bow sight of claim 11 wherein said compensating mirror is closer to said second mirror than to said first mirror and further comprising:

(a) a mount bracket carried by said housing for mounting said bow sight to a bow;

(b) a sight pin bracket carried by said housing and extending from said housing and into a line of sight to said second mirror, whereby at least one sight pin can be fitted to said bow sight and aligned with a target image in said second mirror to determine an arrow trajectory; and (c) adjusting means in cooperation with said compensating mirror and said housing for causing the target image in said compensating mirror and reflected to said second mirror to align with the target image reflected from said first mirror to said second mirror when said top mirror and said compensating mirror are both focussed on a target.

19. The bow sight of claim 18 further comprising light means mounted in said housing beneath said second mirror for illuminating said second mirror.

20. The bow sight of claim 19 further comprising hood means cooperating with said housing and extending around the periphery of said first opening.

* * * * *